US012806510B1

(12) United States Patent
Nicholson

(10) Patent No.: US 12,806,510 B1
(45) Date of Patent: Nov. 24, 2026

(54) TABLE SHUFFLEBOARD GAME

(71) Applicant: David Nicholson, San Diego, CA (US)

(72) Inventor: David Nicholson, San Diego, CA (US)

( * ) Notice: Subject to any disclaimer, the term of this patent is extended or adjusted under 35 U.S.C. 154(b) by 311 days.

(21) Appl. No.: 18/602,948

(22) Filed: Mar. 12, 2024

(51) Int. Cl.
*A63F 7/00* (2006.01)
*A63F 7/02* (2006.01)
*A63F 7/30* (2006.01)

(52) U.S. Cl.
CPC ..... *A63F 7/0005* (2013.01); *A63F 7/02* (2013.01); *A63F 7/022* (2013.01); *A63F 2007/3025* (2013.01)

(58) Field of Classification Search
CPC ..... A63F 7/0005; A63F 7/02; A63F 7/022; A63F 2007/3025
See application file for complete search history.

(56) References Cited

U.S. PATENT DOCUMENTS 175,254 A * 3/1876 Oberly ..... A63F 7/02 273/394
572,056 A * 11/1896 Jeffries ..... A63F 7/0005 273/125 R
702,088 A * 6/1902 Cameron ..... A63F 7/0005 273/125 R
739,254 A * 9/1903 Borland ..... A63F 7/0005 273/125 R
2,062,166 A * 11/1936 Delwiche ..... A63D 15/00 273/125 R
3,174,752 A 3/1965 Plentis
3,865,377 A * 2/1975 Cooper ..... A63F 7/0005 273/127 D
D361,795 S 8/1995 Abrudan
6,502,819 B2 1/2003 Rieber et al.
6,893,017 B1 5/2005 Thomas et al.
8,435,127 B2 5/2013 Boessling
11,638,866 B2 * 5/2023 Dowling ..... A63F 7/0017 273/125 R (Continued)

OTHER PUBLICATIONS

"Golf Connect 4 = Best Game Ever!!," uploaded to YouTube Feb. 2, 2018; available on the internet via URL https://www.youtube.com/watch?v=JAwHzWJWkVc (Year: 2018).*

(Continued)

*Primary Examiner* — Audrey B. Walter
(74) *Attorney, Agent, or Firm* — Cramer Patent & Design, PLLC.; Aaron R. Cramer

(57) ABSTRACT

The present invention relates to a tabletop pattern building game designed to provide an entertaining blend of skill, strategy, and chance. The game features a playing surface equipped with a viewing window, target apertures, and an outer barrier. Unique game pieces, designed to interact with various game elements, enhance the strategic depth and skill involved in gameplay. The game also includes a folding leg system for adjusting the playing surface height, and an innovative pattern building matrix beneath the playing surface. Game pieces pass through the target apertures and are routed via channels to the matrix, where they contribute to pattern formation. The game is further enhanced by a collection bin and an end gate for game piece retrieval and reset. This invention represents a significant advancement in tabletop gaming, offering a new and engaging experience for players.

9 Claims, 3 Drawing Sheets

(56) References Cited

U.S. PATENT DOCUMENTS

| | | | | |
|---|---|---|---|---|
| 2005/0269785 | A1* | 12/2005 | Shiu | A63F 7/022<br>273/441 |
| 2023/0115638 | A1* | 4/2023 | Connors | A63F 7/0023<br>273/123 R |

OTHER PUBLICATIONS

Golf Connect 4 = Best Game Ever!!. Video [online]. By How Ridiculous YouTube.com [posted on Feb. 2, 2018; retrieved on Apr. 26, 2021]. Retrieved from the Internet: <URL: https://www.youtube.com/watch?v=JAwHzWJWKVc>.

* cited by examiner

TABLE SHUFFLEBOARD GAME

RELATED APPLICATIONS

None.

FIELD OF THE DEVICE

The present invention pertains to the field of tabletop games, specifically to games that combine elements of skill and chance in a pattern-building context. It relates to games designed to be played on a flat surface, involving physical game pieces, and requiring a combination of strategic planning and dexterity.

BACKGROUND OF THE DEVICE

Traditional tabletop games often lacked dynamic interaction between the game environment and the players, relying heavily on static game boards and simplistic piece movements. Recognizing the need for a more engaging and skill-oriented game, the present invention introduces a unique combination of physical skill, strategy, and chance. The integration of a pattern-building matrix, distinctively designed game pieces, and a dynamically adjustable playing surface introduces a novel way of gaming that enhances player engagement and satisfaction. These improvements address limitations found in previous games by offering a more versatile, interactive, and enjoyable gaming experience.

SUMMARY OF THE DEVICE

Embodiments of the present disclosure may include a tabletop pattern building game, including a playing surface. Embodiments may also include a plurality of target apertures located at a distal end of the playing surface. Embodiments may also include an underside game area beneath the playing surface. Embodiments may also include a folding leg system connected to the underside game area.

Embodiments may also include a pattern building matrix located within the underside game area. Embodiments may also include a collection bin positioned to collect game pieces from the pattern building matrix. In some embodiments, the playing surface includes a start line for initiating game piece movement, and the game pieces may be propelled from the start line towards the target apertures.

In some embodiments, the playing surface may be manufactured from a plastic material and includes an outer barrier along its perimeter. In some embodiments, the outer barrier may be designed to keep game pieces on the playing surface and enable various shot types, including ricochet and rebound shots. Embodiments may also include each game piece may include a ball bearing contained within an outer collar. In some embodiments, the target apertures may be sized to allow the passage of the game pieces from the playing surface to the underside game area.

In some embodiments, the underside game area may include an inclined surface to facilitate the movement of game pieces. In some embodiments, the inclined surface may be mechanically coupled to the folding leg system, allowing adjustment of the playing surface's elevation. In some embodiments, the folding leg system includes a pivot point to facilitate folding and storage of the game. In some embodiments, the folding leg system may be made from metal tubing.

In some embodiments, the pattern building matrix may be configured to receive game pieces from the target apertures through routing channels. In some embodiments, the routing channels guide the game pieces into specific columns of the pattern building matrix. In some embodiments, the collection bin may be positioned to receive game pieces from the pattern building matrix upon lifting an end gate. In some embodiments, the end gate may be movable along an end gate lift travel path to facilitate the release of game pieces into the collection bin.

In some embodiments, the tabletop pattern building game may include a viewing window at a proximal end of the playing surface. In some embodiments, the viewing window may be made of clear plastic and allows players to view the underside game area and the pattern building matrix. In some embodiments, the game pieces may be available in different colors to distinguish between players or teams during gameplay.

In some embodiments, the game may be operable by players who alternate turns sliding game pieces along the playing surface towards the target apertures. Embodiments may also include successful entry of a game piece into a target aperture results in its movement through the routing channels to the pattern building matrix, contributing to pattern formation.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
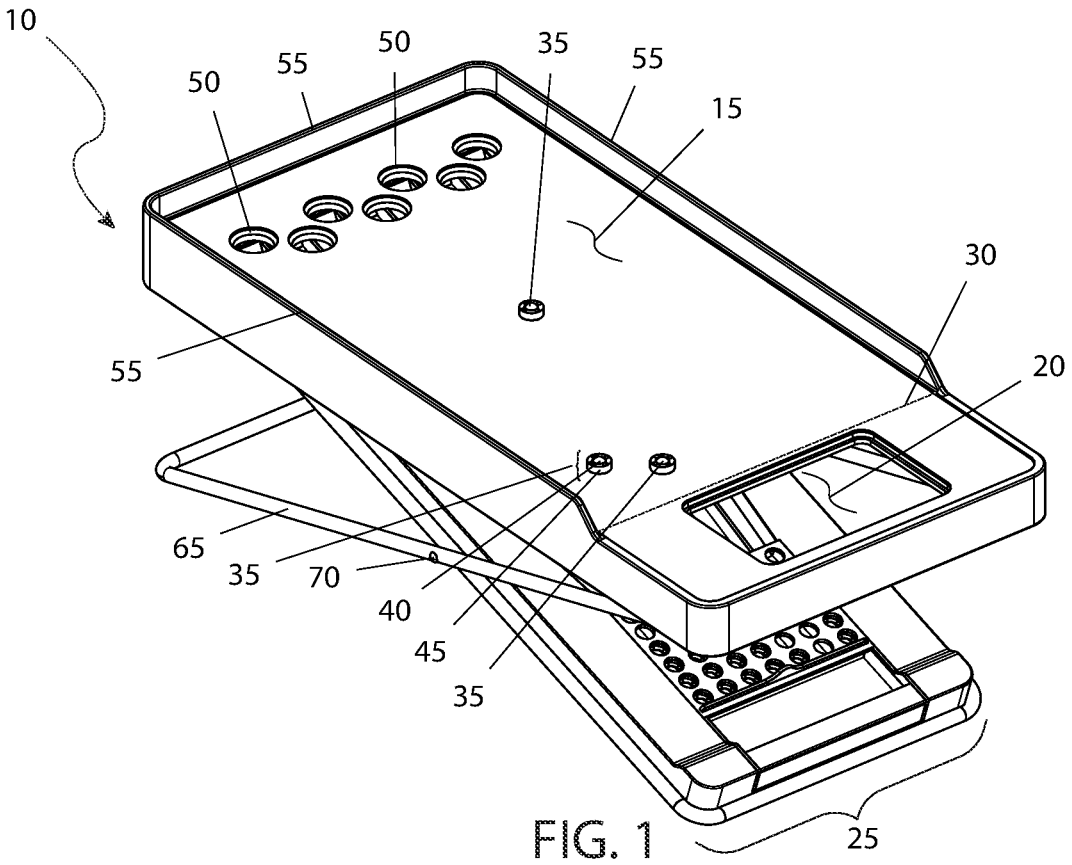
FIG. 1 is an upper perspective view of the tabletop pattern building game 10, according to the preferred embodiment of the present invention.

10 tabletop pattern building game
15 playing surface
20 viewing window
25 underside game area
30 start line
35 game piece
40 ball bearing
45 outer collar
50 target aperture
55 outer barrier
60 inclined surface
65 folding leg system

70 pivot point
75 routing channel
80 pattern building matrix
85 end gate
90 end gate lift travel path "a"
95 collection bin
100 game piece travel path "b"

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, an upper perspective view of the tabletop pattern building game 10, according to the preferred embodiment of the present invention is disclosed. The tabletop pattern building game (herein also described as the "game") 10, provides for an entertaining activity that relies on chance as well as player skill to provide a pattern-building game 10. The game 10 provides for a playing surface 15, envisioned to be manufactured from plastic, with the overall approximated dimensions of thirty-one inches (31 in.) long and fifteen inches (15 in.) wide. The proximal end of the playing surface 15 is provided with a viewing window 20, envisioned to made of clear plastic, which allows players to view the underside game area 25. The underside game area 25 will be described in greater detail herein below. The proximal side of the playing surface 15 is also provided with a start line 30. During play, a player will grasp a game piece 35, which comprises a conventional ball bearing 40 contained within an outer collar 45, and place it behind the start line 30 and propel it by hand to the distal end of the playing surface 15 towards one (1) of seven (7) target apertures 50. The open diameter of the target apertures 50 are such that they will accept the game pieces 35 and allow it to fall through to the underside game area 25. An outer barrier 55, envisioned to be made of blow molded plastic, is provided along the three (3) perimeter sides of the playing surface 15. The outer barrier 55 keeps the game pieces 35 on the playing surface 15 and enables for ricochet shots, rebound shots and other plays, depending on the skill of the player. The game pieces 35 would be made available in different colors to keep track of the game pieces 35 in relation to various players or player teams.

Figure 2:
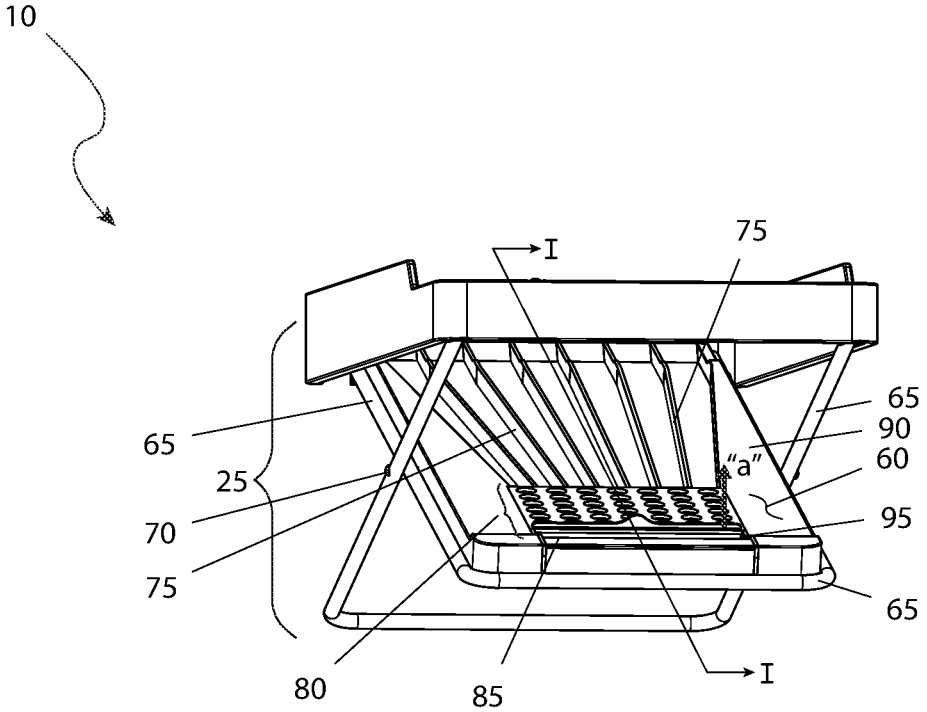
FIG. 2 is a lower perspective view of the tabletop pattern building game 10, according to the preferred embodiment of the present invention.

Referring next to FIG. 2, a lower perspective view of the game 10, according to the preferred embodiment of the present invention is depicted. The underside game area 25 is provided with an inclined surface 60, envisioned to be manufactured from blow molded plastic. The inclined surface 60 is mechanically coupled to one (1) half of a folding leg system 65. The folding leg system 65 is provided with a pivot point 70 that allows for elevation of the playing surface 15 (as shown in FIG. 1) to a height of approximately eleven and a quarter inches (11¼ in.). This elevation is envisioned to provide for a preferred playing surface 15 when the game 10 is placed on a table or similar surface. When the folding leg system 65 is collapsed about the pivot point 70, the folding leg system 65 as well as the inclined surface 60 will fold flat allowing for storage in a small and thin location, when the game 10 is not in use. The folding leg system 65 is envisioned to be manufactured from one-half inch (½ in.) diameter round metal tubing. The upper part of the inclined surface 60 comprises seven (7) routing channels 75. The routing channels 75 route the game pieces 35 (as shown in FIG. 1) as they fall through the target apertures 50 (as shown in FIG. 1) and into a pattern building matrix 80. As such, various patterns are developed in the pattern building matrix 80 that are pre-agreed to the players and/or teams, which determine the end of game and subsequent winners. At the conclusion of a game or game segment, an end gate 85 may be lifted upward along an end gate lift travel path "a" 90 to allow the collected game pieces 35 to fall into a collection bin 95. The game pieces 35 are then removed and relocated to the playing surface 15 (as shown in FIG. 1) to play another game.

Figure 3:
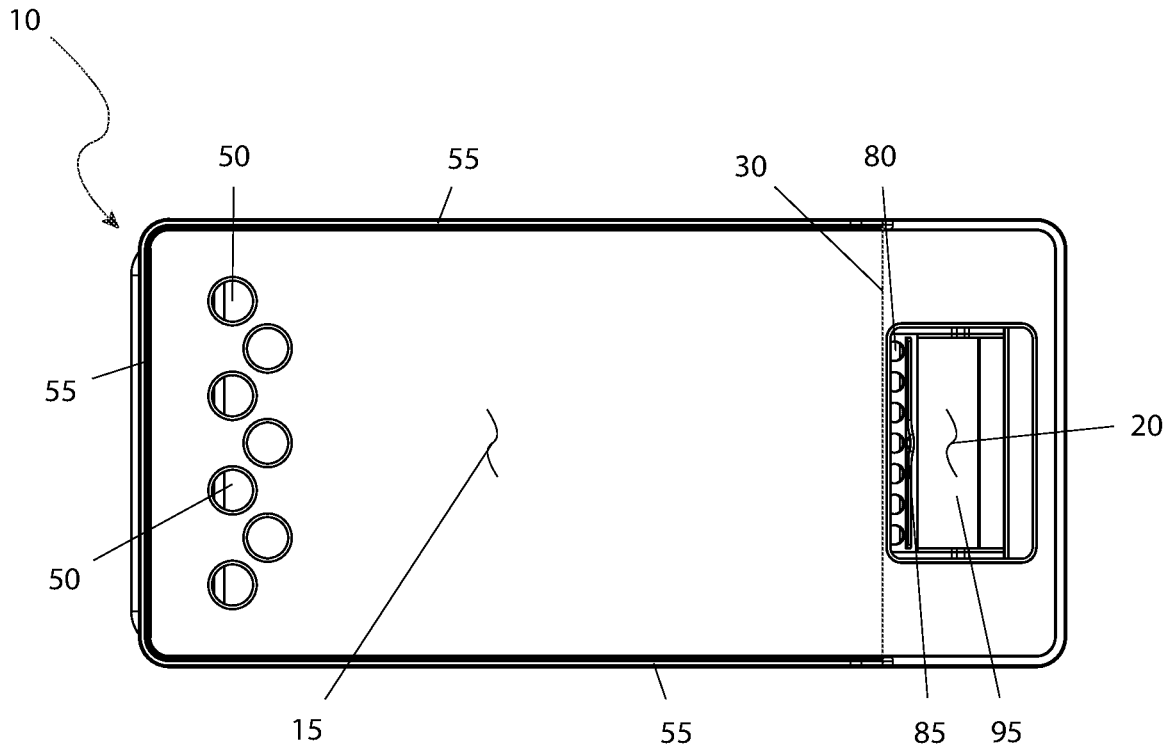
FIG. 3 is a top view of the tabletop pattern building game 10, according to the preferred embodiment of the present invention.

Referring now to FIG. 3, a top view of the game 10, according to the preferred embodiment of the present invention is shown. This view clearly defines the playing surface 15 with the viewing window 20 at the proximal end and the target apertures 50 at the distal end. The viewing window 20 is envisioned to be approximately seven and three-quarters of an inch (7¾ in.) in width and four and three-quarters of an inch (4¾ in.) in depth. As such, vision into the underside game area 25 (as shown in FIG. 1) is allowed, thereby permitting player observation of the pattern building matrix 80, the end gate 85 and the collection bin 95. It is also envisioned that players may look directly at the pattern building matrix 80 from the exterior of the game 10 as well. The outer barrier 55 encompass the perimeter of the playing surface 15.

Figure 4:
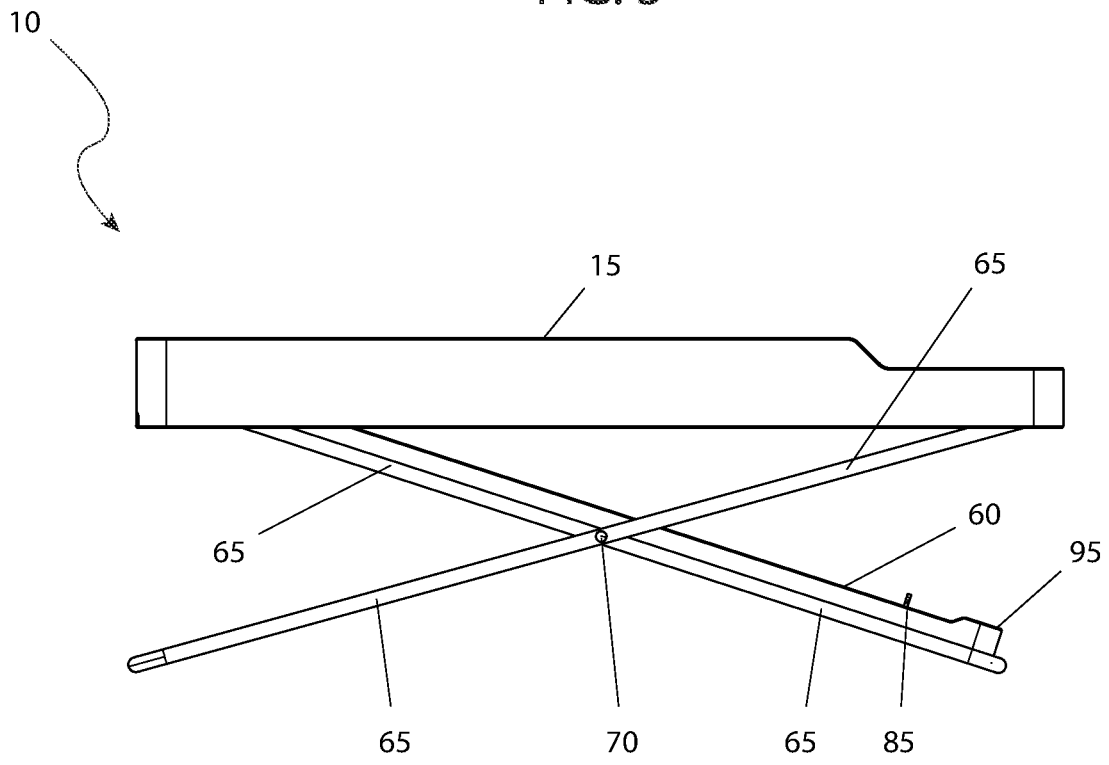
FIG. 4 is a side view of the tabletop pattern building game 10, according to the preferred embodiment of the present invention.

Referring next to FIG. 4, a side view of the game 10, according to the preferred embodiment of the present invention is disclosed. This view clearly depicts the configuration of the folding leg system 65, with its pivot point 70 and its ability to fold flat, in much the same manner as an ironing board. The inclined surface 60 is located coplanar with one (1) leg segment of the folding leg system 65 to thus allow the game pieces 35 (as shown in FIG. 1) to collect via gravity. The game pieces 35 are held captive from further falling by the end gate 85 within the pattern building matrix 80 (as shown in FIG. 2). Once the end gate 85 is lifted upward along the end gate lift travel path "a" 90 (as shown in FIG. 2), gravity once again allows all of the game pieces 35 to fall into the collection bin 95.

Figure 5:
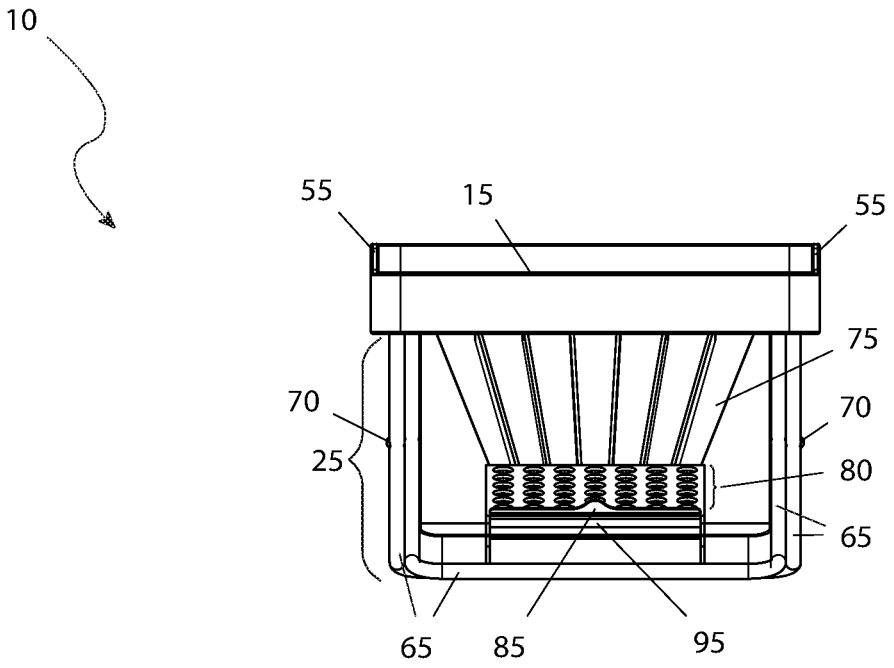
FIG. 5 is an end view of the tabletop pattern building game 10, according to the preferred embodiment of the present invention; and, FIG. 6 is a sectional view of the tabletop pattern building game 10, as seen along a line I-I, as shown in FIG. 2, according to the preferred embodiment of the present invention.

Referring now to FIG. 5, an end view of the game 10, according to the preferred embodiment of the present invention is depicted. The end view is as seen from the proximal end of the game 10. The playing surface 15 with the outer barrier 55 is visible on the upper portion of the game 10. The folding leg system 65 with the two (2) pivot points 70 are visible as part of the underside game area 25. The routing channels 75 are visible to route the game pieces 35 from the target apertures 50 (not visible in this figure due to illustrative limitations) to the pattern building matrix 80. As aforementioned described, the end gate 85 and the collection bin 95 allow for collection of the game pieces 35 from the pattern building matrix 80 at the conclusion of a game.

Figure 6:
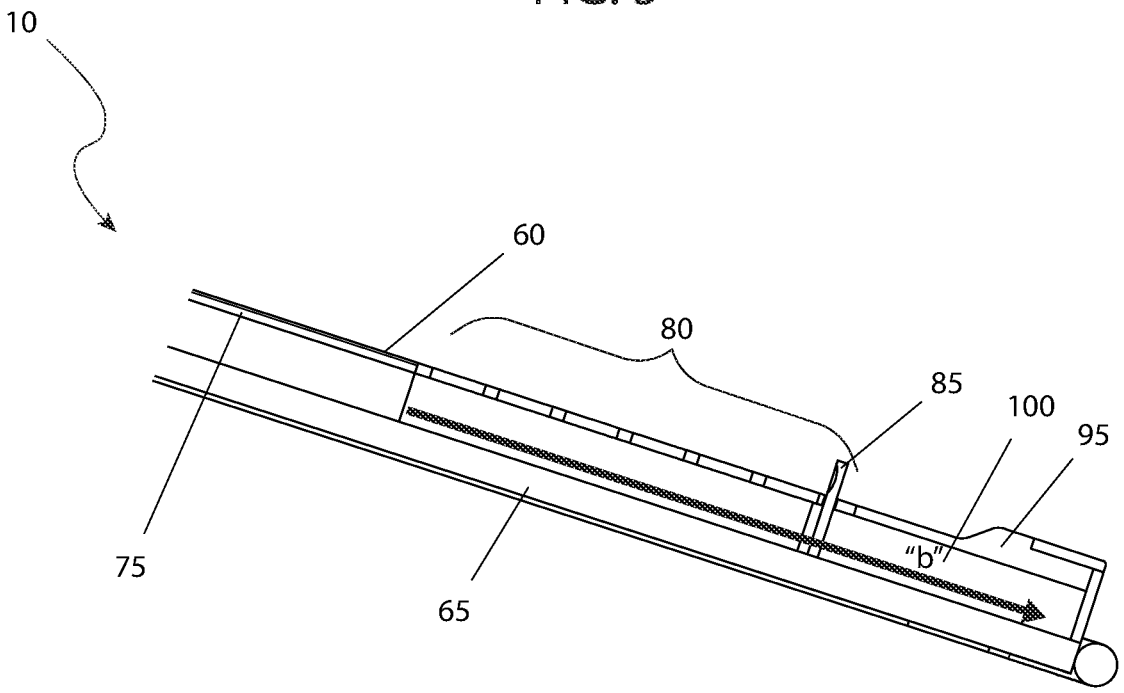

Referring to FIG. 6, a sectional view of the game 10, as seen along a line I-I, as shown in FIG. 2, according to the preferred embodiment of the present invention is shown. This view discloses a game piece travel path "b" 100 as an individual game piece 35 moves through the routing channels 75 and into the pattern building matrix 80 where various patterns can be developed. The inclined surface 60 is held captive within the folding leg system 65. When the end gate 85 is lifted along the end gate lift travel path "a" 90 (as shown in FIG. 2), the game piece 35 within the pattern building matrix 80 will fall into the collection bin 95 for retrieval and subsequent continued game play.

2. Operation of the Preferred Embodiment

The preferred embodiment of the present invention can be utilized by the common user in a simple and effortless manner with little or no training. It is envisioned that the game 10 would be constructed in general accordance with FIG. 1 through FIG. 6. The user would procure the game 10 from conventional procurement channels such as toy stores, discount stores, department stores, mail order and internet supply houses and the like.

After procurement and prior to utilization, the game 10 would be prepared in the following manner: the folding leg system 65 would be unfolded and extended via use of the pivot point 70 and placed upon a suitable surface such as a table to allow all players to reach the playing surface 15; and, all game pieces 35 are divided by colors amongst the various players or teams. At this point in time, the game 10 is ready for use.

During utilization of the game 10, the players would alternate turns sliding the game pieces 35 along the playing surface 15 from behind the start line 30 towards the target apertures 50 at the distal end of the playing surface 15. As the game pieces 35 fall through the target apertures 50, they gain access to the routing channels 75 which guide the game pieces 35 into the pattern building matrix 80 so that the game pieces 35 may contribute to building the specific pattern for the player or team that played the game pieces 35. Such an action may interfere with the other player or team attempting to build their specific pattern, or both. The first player or team to complete their specific pattern using their game pieces 35 would be declared the winner.

After use of the game 10, all game pieces 35 would be placed in the collection bin 95, the folding leg system 65 retracted along the pivot point 70 and stored until played again at a future date in a repeating and cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tabletop pattern building game, comprising:
a playing surface;
a plurality of target apertures located at a distal end of the playing surface;
an underside game area beneath the playing surface;
a pattern building matrix located within the underside game area;
a plurality of routing channels located within the underside game area;
an inclined surface within the underside game area to facilitate the movement of game pieces;
a collection bin;
an end gate movable between a closed position retaining game pieces within the pattern building matrix and an open position releasing game pieces into the collection bin; and,
wherein the playing surface includes a starting end for initiating game piece movement, and the game pieces are configured to be propelled from the starting end towards the target apertures at the distal end.

2. The tabletop pattern building game of claim 1, wherein:
the playing surface is manufactured from a plastic material and includes an outer barrier along its perimeter; and,
the outer barrier is designed to keep game pieces on the playing surface and enable various shot types, including ricochet and rebound shots.

3. The tabletop pattern building game of claim 1, wherein:
each game piece comprises a ball bearing contained within an outer collar; and,
the target apertures are sized to allow a passage of the game pieces from the playing surface to the underside game area.

4. The tabletop pattern building game of claim 1, wherein:
the pattern building matrix is configured to receive game pieces from the target apertures through the routing channels; and,
the routing channels guide the game pieces into specific columns of the pattern building matrix.

5. The tabletop pattern building game of claim 1, further comprising:
a viewing window at a proximal end of the playing surface; and,
wherein the viewing window is made of clear plastic and allows players to view the underside game area and the pattern building matrix.

6. The tabletop pattern building game of claim 1, wherein the game pieces are available in different colors to distinguish between players or teams during gameplay.

7. The tabletop pattern building game of claim 1, wherein:
the game is operable by players who alternate turns sliding game pieces along the playing surface towards the target apertures; and,
successful entry of a game piece into a target aperture results in its movement through the routing channels to the pattern building matrix, contributing to pattern formation.

8. The tabletop pattern building game of claim 1, further comprising:
a folding leg system for supporting the game; and,
wherein the inclined surface is mechanically coupled to the folding leg system, allowing adjustment of a playing surface's elevation.

9. The tabletop pattern building game of claim 8, wherein:
the folding leg system includes a pivot point to facilitate folding and storage of the game; and, the folding leg system is made from metal tubing.

* * * * *